US007314532B2

(12) United States Patent
Ikeda et al.

(10) Patent No.: US 7,314,532 B2
(45) Date of Patent: Jan. 1, 2008

(54) HIGH-STRENGTH FORGED PARTS HAVING HIGH REDUCTION OF AREA AND METHOD FOR PRODUCING SAME

(75) Inventors: Shushi Ikeda, Kobe (JP); Koichi Makii, Kobe (JP); Hiroshi Akamizu, Kobe (JP); Yoichi Mukai, Kakogawa (JP); Koh-ichi Sugimoto, Ueda (JP)

(73) Assignee: Kabushiki Kaisha Kobe Seiko Sho (Kobe Steel, Ltd.), Kobe-shi (JP)

( * ) Notice: Subject to any disclaimer, the term of this patent is extended or adjusted under 35 U.S.C. 154(b) by 446 days.

(21) Appl. No.: 10/785,080

(22) Filed: Feb. 25, 2004

(65) Prior Publication Data

US 2004/0226635 A1 Nov. 18, 2004

(30) Foreign Application Priority Data

Mar. 26, 2003 (JP) ..... 2003-085674
Oct. 14, 2003 (JP) ..... 2003-353967

(51) Int. Cl.
*C22C 38/02* (2006.01)
*C22C 38/04* (2006.01)
*C21D 8/00* (2006.01)

(52) U.S. Cl. ..... 148/320; 148/649; 148/333; 148/334; 148/335; 148/336; 148/654

(58) Field of Classification Search ..... 148/649, 148/320, 333–336, 660–663, 654, 648; 420/8, 420/104–112
See application file for complete search history.

(56) References Cited

U.S. PATENT DOCUMENTS 5,505,796 A 4/1996 Kawano et al.

(Continued)

FOREIGN PATENT DOCUMENTS

| | | | |
|---|---|---|---|
| EP | 1 365 037 A1 | | 11/2003 |
| JP | 2001-220641 | * | 8/2001 |
| JP | 2001-220648 | * | 8/2001 |
| JP | 2004-285430 | | 10/2004 |

OTHER PUBLICATIONS

Unedited computer-generated English translation of Japanese patent 2001-220641, Seto, Kazhiro et al, Aug. 14, 2001.*
U.S. Appl. No. 11/290,640, filed Dec. 1, 2005, Ikeda, et al.
U.S. Appl. No. 11/110,716, filed Apr. 21, 2005, Ikeda, et al.

(Continued)

*Primary Examiner*—Deborah Yee

(74) *Attorney, Agent, or Firm*—Oblon, Spivak, McClelland, Maier & Neustadt, P.C.

(57) ABSTRACT

A high-strength forged part is disclosed which comprises a base phase structure, comprising 30% or more of ferrite in terms of a space factor, and a second phase structure, comprising bainite and/or martensite, and retained austenite having an average grain diameter of 5 μm or less and a content represented by $50\times[C]<[V_{\gamma R}]<150\times[C]$, wherein $[V_{\gamma R}]$ represents a space factor of the retained austenite (γR) and [C] represents the mass % of C in the forged part. Furthermore, a high-strength forged part is disclosed which comprises a base phase structure, comprising 50% or more of tempered bainite or tempered martensite in terms of a space factor, and a second phase structure, comprising martensite and 3% to 30% retained austenite in terms of a space factor, wherein the portion of the retained austenite and martensite having an aspect ratio of 2 or less is 25% or less in terms of a space factor.

7 Claims, 4 Drawing Sheets

U.S. PATENT DOCUMENTS

| | | | | |
|---|---|---|---|---|
| 6,306,527 | B1 | 10/2001 | Ikeda et al. | |
| 6,316,127 | B1 | 11/2001 | Ikeda et al. | |
| 6,319,338 | B1 * | 11/2001 | Kawano et al. | 148/328 |
| 6,544,354 | B1 * | 4/2003 | Kawano et al. | 148/320 |
| 2004/0226635 | A1 | 11/2004 | Ikeda et al. | |

OTHER PUBLICATIONS

U.S. Appl. No. 11/044,185, filed Jan. 28, 2005, Ikeda, et al.
U.S. Appl. No. 11/030,100, filed Jan. 7, 2005, Akamizu, et al.

* cited by examiner

COMPARATIVE EXAMPLE NO. 5

COMPARATIVE EXAMPLE NO. 6

INVENTIVE EXAMPLE

COMPARATIVE EXAMPLE NO. 5

10μm

COMPARATIVE EXAMPLE NO. 6

5μm

INVENTIVE EXAMPLE NO. 7

5μm

HIGH-STRENGTH FORGED PARTS HAVING HIGH REDUCTION OF AREA AND METHOD FOR PRODUCING SAME

BACKGROUND OF THE INVENTION

1. Field of the Invention

The present invention relates to high-strength forged parts having a high reduction of area and a method for producing the same. More particularly, the present invention is concerned with high-strength forged parts superior in elongation and also in the balance of strength and reduction of area in a high strength region of about 600 MPa or more, as well as a method for producing the same. As typical examples of the "high-strength forged parts" according to the present invention there are mentioned near net shape forged parts, in which are included not only primary forged parts, but also precision-forged parts such as secondary and tertiary forged parts obtained by further forging (e.g., cold and warm forging) of the primary forged parts, and final products obtained by forming those forged parts into complicated shapes.

2. Description of the Prior Art

The use of forged parts is increasing in such industrial fields as automobiles, machinery, and electrical machines and appliances. Forged parts are generally produced by performing various forgings (workings) different in heating temperature and by subsequent refining (heat treatment) such as quenching and tempering. For example, in automobiles, hot-forged parts (heating temperature: 1100° to 1300° C.) and warm-forged parts (heating temperature 600° to 800° C.) are widely used for crank shafts, connecting rods and transmission gears, and cold-forged parts (heating at room temperature) are widely used for gears, pinion gears, steering shafts and valve lifters.

The forged parts in question are required to possess not only a high strength but also a high reduction of area. Such a requirement has been increasing recently. In this connection, the use of TRIP steel for such forged parts is now under study.

When retained austenite (γR) is produced in structure, the γR undergoes transformation (transformation-induced plasticity: TRIP) during deformation in working, with consequent improvement of ductility. TRIP steel utilizes this property effectively. Since TRIP steel is superior in both strength and ductility, it is widely used particularly for collision members and suspension members in automobiles. For example, in U.S. Pat. No. 5,505,796 there is disclosed a TRIP type composite phase steel (PF steel) comprising polygonal ferrite, bainite, and retained austenite. It is described therein that the PF steel possesses excellent punch stretch formability (ductility) and deep drawability and is superior in shock absorbability. In European Patent Publication 1,365,037, there are disclosed TRIP type composite phase steels each using tempered martensite or tempered bainite as a base phase structure and retained austenite as a second phase structure. It is described therein that these steel sheets are superior in all of strength, elongation, and stretch flange formability.

However, it turned out for the first time from the results of studies made by the present inventors that if the above TRIP steels are forged as they are by the foregoing method (quenching and tempering after forging), a coarse γR is produced in a large amount and acts as a starting point of fracture, with consequent occurrence of drawbacks such as cracking. Such drawbacks have heretofore occurred also in case of using other steels than TRIP steel, but in the studies made by the present inventors there occurred a marked lowering in the reduction of area and a marked deterioration of toughness.

Further, in the conventional method, two heat treatment steps, which are forging treatment and subsequent refining treatment involving quenching and tempering, are carried out separately, thus giving rise to the problem of an increase of cost and a lowering of both productivity and production efficiency.

Therefore, it is keenly desired to provide a novel high-strength forged part superior in elongation and also in the balance of strength and reduction of area even if the working ratio is set high, as well as a forging method which can produce such a forged part by a single heat treatment without going through such two heat treatment steps as in the prior art.

SUMMARY OF THE INVENTION

The present invention has been accomplished in view of the above-mentioned circumstances and it is an object of the invention to provide a novel high-strength forged part superior in elongation and also in the balance of strength and reduction of area even if the working ratio is set high, provide a novel method which can produce such a forged part efficiently, and further provide an ultra-high-strength forged part obtained by further forging the high-strength forged part.

A high-strength forged part according to the present invention capable of achieving the above-mentioned object and having a high reduction of area comprises a base phase structure and a second phase structure and contains the following components in mass % (also in the following):

C: 0.1% to 0.6%

Si+Al: 0.5% to 3%

Mn: 0.5% to 3%

P: 0.15% or less (not including 0%)

S: 0.02% or less (including 0%), the base phase structure containing 30% or more of ferrite in terms of a space factor relative to the entire structure, the second phase structure comprising retained austenite, as well as bainite and/or martensite, the content of the retained austenite being represented by the following expression (1) relative to the entire structure, an average grain diameter, d, of the second phase structure being 5 μm or less, and a space factor of a coarse portion of (1.5×d) or more in an average grain diameter contained in the second phase structure being 15% or less:

$$50\times[C]<[V_{\gamma R}]<150\times[C] \quad (1)$$

where $[V_{\gamma R}]$ stands for a space factor of the retained austenite relative to the entire structure and [C] stands for the content (mass %) of C in the forged part.

The above high-strength forged part further containing a total of 1% or less (not including 0%) of Cr and/or Mo, 0.5% or less (not including 0%) of Ni, and/or 0.5% or less (not including 0%) of Cu, the above high-strength forged part further containing at least one of 0.1% or less (not including 0%) of Ti0.1% or less (not including 0%) of Nb, and 0.1% or less (not including 0%) of V, the above high-strength forged part further containing 0.003% or less (not including 0%) of Ca and/or 0.003% or less (not including 0%) of REM, and the above high-strength forged part further containing 0.003% or less (not including 0%), are all preferred modes of the present invention.

The gist of a method for producing the above high-strength forged part according to the present invention capable of achieving the foregoing object of the invention resides in holding steel having any of the above compositions at a temperature of (Ae1 point—30° C.) to Ae3 point for 10 seconds or longer, allowing the steel to be forged at that temperature, thereafter cooling the steel to a temperature of 325° to 475° C. at an average cooling rate of 3° C./s or more, and holding the steel in that temperature range for 60 to 3600 seconds.

Target mechanical characteristics in the above construction satisfy a high strength of about 600 MPa or more, satisfy a product (TS×RA) of tensile strength Ts (MPa) and reduction of area RA (%) of 20000 or more (preferably 25000 or more) even if the working ratio is increased to 70%, and further satisfy a total elongation of 5% or more (preferably 10% or more).

Another high-strength forged part according to the present invention capable of achieving the foregoing object of the invention and having a high reduction of area comprises a base phase structure and a second phase structure and contains the following components in mass % (also in the following):

C: 0.1% to 0.5%
Si+Al: 0.5% to 3%
Mn: 0.5% to 3%
P: 0.15% or less (not including 0%)
S: 0.02% or less (including 0%), the base phase structure containing 50% or more of tempered bainite or tempered martensite in terms of a space factor relative to the entire structure, the second phase structure containing retained austenite and martensite, the content of the retained austenite being 3% to 30% in terms of a space factor relative to the entire structure, and a portion of the retained austenite and martensite, which portion is 2 or less in an aspect ratio, being 25% or less in terms of a space factor.

The above high-strength forged part further containing a total of 1% or less (not including 0%) of Cr and/or Mo, 0.5% or less (not including 0%) of Ni, and/or 0.5% or less (not including 0%) of Cu, the above high-strength forged part further containing at least one of 0.1% or less (not including 0%) of Ti, 0.1% or less (not including 0%) of Nb, and 0.1% or less (not including 0%) of V, the above high-strength forged part further containing 0.003% or less (not including 0%) of Ca and/or 0.003% or less (not including 0%) of REM, and the above high-strength forged part further containing 0.003% or less (not including 0%) of B, are all preferred modes of the present invention.

Further, the gist of a method for producing the above high-strength forged product according to the present invention capable of achieving the foregoing object of the invention resides in holding steel at a temperature of (Ae1 point—30° C.) to (Ae3 point—30° C.) for 10 seconds or more, the steel having any of the above compositions and incorporating therein an untempered bainite structure, a quenched bainite structure, an untempered martensite structure, or a quenched martensite structure, allowing the steel to be forged at that temperature, thereafter cooling the steel to a temperature of 325° to 475° C. at an average cooling rate of 3° C./s or more, and holding the steel in that temperature range for 60 to 3600 seconds.

Target mechanical characteristics in the above construction satisfy a high strength of about 600 MPa or more, satisfy a product (TS×RA) of tensile strength TS (MPa) and reduction of area RA (%) of 25000 or more (preferably 30000 or more) even if the working ratio is increased to 70%, and further satisfy a total elongation of 20% or more (preferably 25% or more).

Since the present invention is constructed as above, a high-strength forged part superior in elongation and also in the balance of strength and reduction of area can be produced even under an increased working ratio and in a high strength region of about 600 MPa or more, efficiently by only a single heat treatment without going through such two heat treatment steps as in the prior art.

THE DETAILED DESCRIPTION OF THE PREFERRED EMBODIMENTS

Figure 1:
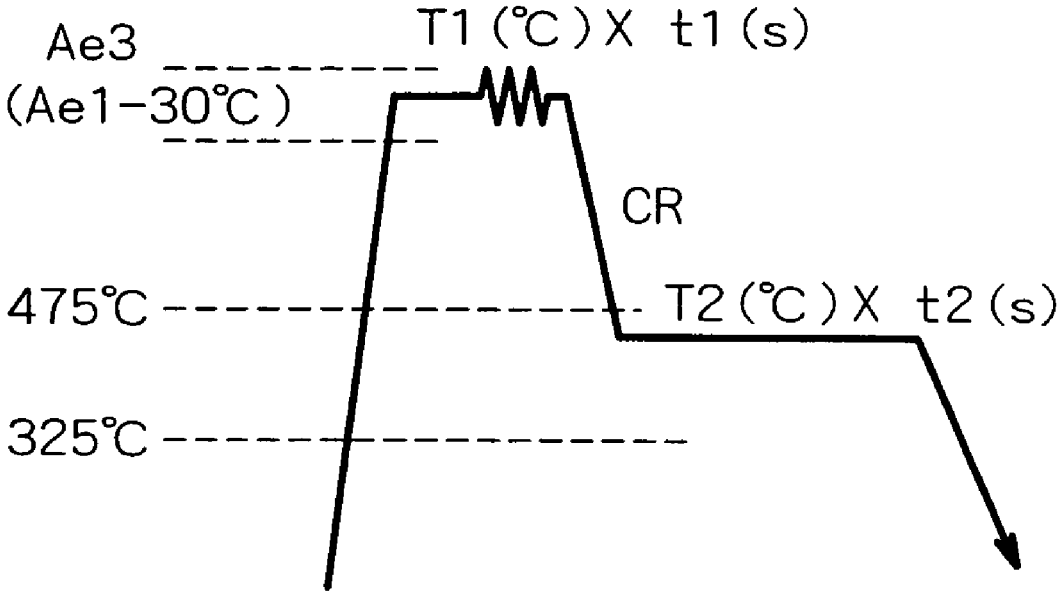
FIG. 1 is a schematic diagram illustrating a heat treatment step in the present invention (first invention)

Reference is here made to the following problem: "Conventional forged parts are inferior in elongation and also in the balance of strength and reduction of area, and are difficult to undergo subsequent working; further, in the conventional method, two such heat treatment steps as forging and refining which involves quenching and tempering are carried out separately, with consequent increase of cost and lowering of productivity and production efficiency." In an effort to eliminate this problem the present inventors have made earnest studies taking note of TRIP steel. As noted earlier, TRIP steel is superior in the balance of strength and ductility (especially total elongation) because of formation of retained austenite (γR) We have thought that if such excellent characteristics derived from retained austenite are applied effectively, there may be obtained a desired forged part.

However, as a result of various basic experiments conducted by the inventors, including those conducted in accordance with conventional methods, it turned out that if TRIP steel is forged as it is, there is not obtained a high-strength forged part superior in the balance between strength and reduction of area. The details thereof will be shown in Examples to be described later. For example, it turned out that if both forging and refining which comprises quenching and tempering are carried out separately as in the prior art ("method A" in the Examples to be described later), there is produced coarse γR or coarse martensite and that a working ratio as high as 50% results in a lowering of the reduction of area. The inventors have also tried a method ("method B" in the Examples to be described later) in which forging is followed by austempering at a two-phase region temperature unlike the conventional method, but the reduction of area proved to be still unsatisfactory although it was somewhat improved in comparison with the conventional method. Also in the above method, such a problem as a lowering of productivity still remains to be solved because heat treatment is conducted twice as in the conventional method.

On the basis of the above basic experiments and in order to let excellent characteristics derived from retained austenite in TRIP steel be exhibited effectively in forged parts, the present inventors have made further studies from the standpoint of preventing the formation of coarse retained austenite and coarse martensite. As a result, the inventors found out that the desired object can be achieved if there is adopted a unique heat treatment comprising performing both annealing and forging at an approximately two-phase region temperature and subsequent austempering at a predetermined temperature. On the basis of this finding the inventors accomplished the present invention.

A description will be given below about conditions for constituting the high-strength forged part according to the first invention.

Reference will be made first to the structure in the first invention.

(1) Base Phase Structure: Ferrite (30% or more)

"Ferrite" as referred to herein means polygonal ferrite, i.e., ferrite low in dislocation density. Particularly, as in the present invention, when it is intended to improve characteristics in such a high strength region as about 600 MPa or more, ferrite is important as a structure which contributes to the improvement of elongation characteristic. For allowing such a function of ferrite to be exhibited effectively, a space factor of ferrite relative to the entire structure is set at 30% or more (preferably 40% or more, more preferably 50% or more). However, if the space factor exceeds 80%, it becomes difficult to ensure a required strength and many voids occur from the interface between ferrite and a second phase (to be described later), resulting in deterioration of the reduction of area. It is therefore recommended to set its upper limit to 80% (preferably 70%, more preferably 60%).

(2) Second Phase Structure: Retained Austenite, as well as Bainite and/or Martensite The high-strength forged part contains not only the above base phase structure but also, as a second phase structure, retained austenite (γR), as well as bainite and/or martensite.

(2-1) Retained Austenite

As noted earlier, retained austenite is effective particularly in improving the total elongation. For allowing such a function to be exhibited effectively it is necessary to satisfy the condition of (2-A) which will be described later.

It is recommended that the concentration of C in the retained austenite, ($C_{\gamma R}$), be 0.8% or more. The $C_{\gamma R}$ exerts a great influence on TRIP characteristics, and controlling it to 0.8% or more is effective particularly in improving elongation, etc.

Preferably it is 1% or more, more preferably 1.2% or more. The higher the content of the $C_{\gamma R}$, the more preferred, but in actual operation, an adjustable upper limit is considered to be approximately 1.6%.

(2-2) Bainite and/or Martensite (including 0%)

The second phase structure may further contain bainite and/or martensite (including 0%) as another different structure insofar as the operation of the present invention is not impaired. These components can inevitably be retained in the course of production according to the present invention, but the smaller the content thereof, the more preferred. Preferably, a total content of bainite and/or martensite is 40% or less, more preferably 30% or less.

Further, the second phase structure satisfies the following conditions (2-A) to (2-C).

$$\text{(2-A)}\quad 50\times[C]<[V_{\gamma R}]<150\times[C] \qquad (1)$$

In the above expression, $[V_{\gamma R}]$ stands for a space factor of γR relative to the entire structure and [C] stands for the content of C (mass %) in the forged part.

As will be described later, the content of C in the present invention covers a wide range of 0.1% to 0.6%. Therefore, for allowing the excellent function of retained austenite to be exhibited effectively, it is necessary that $[V_{\gamma R}]$ be determined appropriately in relation to the content of C. The above expression (1) was established from this standpoint.

First, a lower limit of $[V_{\gamma R}]$ is set at 50×[C]. If $[V_{\gamma R}]$ is below 50×[C], desired elongation and reduction of area will not be obtained. It is preferably 60×[C] or more, more preferably 70×[C] or more.

On the other hand, an upper limit of $[V_{\gamma R}]$ is set at 150×[c]. This is because if $[V_{\gamma R}]$ is 150×[C] or more, a large amount of retained austenite will be produced, resulting in the concentration of C in the γR becoming lower and the retained austenite becoming unstable. It is preferably 140×[C] or less, more preferably 130×[C] or less.

(2-B) Average Grain Dia. of Second Phase Structure: d≦5 μm

An average grain diameter, d, of the second phase structure containing γR is set at 5 μm or less. This is because if a coarse second phase structure is produced, it acts as a starting point of cracking and a desired balance of strength and reduction of area is not obtained at an increased working ratio. The smaller the average grain diameter d, the better. It is recommended that the average grain diameter be controlled to preferably 4 μm or less, more preferably 3 μm or less.

(2-C) Space Factor of a Coarse Second Phase Structure Portion of (1.5×d) or More in Average Grain Dia. in the Second Phase Structure ≦15%

The above expression (2-C) means that the ratio (area fraction) of a coarse second phase portion [a second phase portion having a coarse average grain diameter of 1.5 times as large as the average grain diameter d in the second phase structure, hereinafter may be referred to simply as "coarse second phase structure"] to the whole of the second phase structure satisfying the above condition (2-B) is suppressed to 15% or less; in other words, in the present invention, the space factor of "fine second phase structure" exclusive of the "coarse second phase structure" is as large as a value exceeding 85%, whereby it is possible to ensure an excellent balance of strength and reduction of area. As noted earlier, even if TRIP steel is forged by the conventional method, there is not obtained a desired strength-reduction of area balance, but this is attributable to the fact that coarse γR is produced in a large amount. In the present invention, for suppressing the formation of coarse γR, there is adopted a unique heat treatment of "performing austempering at a predetermined temperature after annealing and forging at an approximately two-phase region temperature."

As to the proportion of a coarse second phase structure in the entire second phase structure, the smaller, the better. Preferably it is 10% or less, more preferably 5% or less.

The following description is now provided about basic components of the forged part of the first invention. In the following description, the contents of chemical components are all in mass %.

C: 0.1% to 0.6%

C is an element essential for ensuring a high strength and for ensuring retained austenite. More specifically, C is an element important for ensuring a sufficient content of C in austenite phase (γphase) and for allowing a desired austenite phase to be retained even at room temperature. C is useful for improving elongation characteristic. Particularly, if C is added in an amount of 0.25% or more, the amount of retained austenite increases and the concentration of C into retained austenite becomes higher, thus affording an extremely high elongation. However, if C is added in excess of 0.6%, not only the effect thereof will become saturated, but also there will occur, for example, such a defect as is caused by center segregation into casting.

Si+Al: 0.5% to 3%

Si and Al are elements which effectively suppress the decomposition of retained austenite to form carbide. Particularly, Si is useful also as a solid solution hardening element. For allowing such a function to be exhibited effectively, it is necessary to add Si and Al in an amount of 0.5% or more as a total of the two. Preferably, the total amount of Si and Al is 0.7% or more, more preferably 1% or more. However, even if both elements are added in excess of 3%, the above effect will become saturated, which is wasteful from the economic standpoint. Besides, the addition of such a large amount will cause hot shortness, so an upper limit S+Al is set at 3%, preferably 2.5% or less, more preferably 2% or less.

Mn: 0.5% to 3%

Mn is an element necessary for stabilizing austenite and for obtaining a desired retained austenite. For allowing such a function to be exhibited effectively, it is necessary to add Mn in an amount of 0.5% or more, preferably 0.7% or more, more preferably 1% or more. However, if Mn is added in an amount larger than 3%, there will result a bad influence such as cracking of a cast piece. The amount of Mn is preferably 2.5% or less, more preferably 2% or less.

P: 0.15% or less (not including 0%)

P is an element effective for ensuring a desired retained austenite. For allowing such a function to be exhibited effectively, it is recommended to add P in an amount of 0.03% or more (more preferably 0.05% or more). However, if P is added in an amount exceeding 0.15%, the secondary formability will be deteriorated. More preferably, the amount of P is 0.1% or less.

S: 0.02% or less (including 0%)

S is an element which forms a sulfide inclusion such as MnS and acts as a starting point of cracking to deteriorate formability. The amount of S is preferably 0.02% or less, more preferably 0.015% or less. If the amount of S is decreased to 0.003% or less, the formability deterioration suppressing effect based on a decrease in the amount of S will become saturated, and the cost for decreasing the amount of S is high. Taking these points into account, it is recommended that the lower limit of S be a value larger than 0.003%, more preferably 0.005% or more.

The forged part of the first invention basically contains the above components, with the balance comprising substantially iron and impurities. But the following components as allowable components may be added insofar as the addition thereof does not impair the operation of the present invention.

At least one of Mo: 1% or less (not including 0%), Ni: 0.5% or less (not including 0%), Cu: 0.5% or less (not including 0%), and Cr: 1% or less (not including 0%).

These elements are not only useful as steel strengthening elements but also are effective in stabilizing retained austenite and ensuring a predetermined amount of retained austenite. For allowing such functions to be exhibited effectively, it is recommended to add 0.05% or more (more preferably 0.1% or more) of Mo, 0.05% or more (more preferably 0.1% or more) of Ni, 0.05% or more (more preferably 0.1% or more) of Cu, and 0.05% or more (more preferably 0.1% or more) of Cr. However, even if Mo or Cr is added in excess of 1% or even if Ni or Cu is added in excess of 0.5%, the above effects will become saturated, which is wasteful from the economic standpoint. More preferable amounts are Mo: 0.8% or less, Ni: 0.4% or less, Cu: 0.4% or less, and Cr: 0.8% or less.

At least one of Ti: 0.1% or less (not including 0%), Nb: 0.1% or less (not including 0%), and V: 0.1% or less (not including 0%).

These elements exhibit precipitation strengthening and microstructurization effects and are useful for attaining a high strength. For allowing this effect to be exhibited effectively, it is recommended to add 0.01% or more (more preferably 0.02% or more) of Ti, 0.01% or more (more preferably 0.02% or more) of Nb, and 0.01% or more (more preferably 0.02% or more) of V. However, even if one of these elements is added in an amount of larger than 0.1%, the above effect will become saturated, which is wasteful from the economic standpoint. More preferably, the amounts of Ti, Nb, and V are each 0.08% or less.

Ca and/or REM: 0.003% or less (not including 0%)

Ca and REM (rare earth element) are effective in controlling the form of sulfide in steel and in improving formability. Examples of rare earth elements employable in the present invention include Sc, Y, and lanthanoid. For allowing the above effect to be exhibited effectively, it is recommended that Ca and/or REM be added in an amount of 0.0003% or more (more preferably 0.0005% or more). However, even if at least one of them is added in an amount of larger than 30 ppm, the above effect will become saturated, which is wasteful from the economic standpoint. More preferably, the amounts of Ca and REM are each 0.0025% or less.

B: 0.003% or less (not including 0%)

B has the effect of improving hardenability and enhancing the strength even in a very small amount thereof. For allowing this effect to be exhibited effectively, it is recommended to add B in an amount of 0.0005% or more. However, if B is added in an excessive amount, grain boundaries will become fragile and cracking will occur in casting and rolling, so an upper limit thereof is set at 0.003%, more preferably 0.002% or less.

The forged part of the first invention contains the above basic components and optional components and may further contain other allowable components insofar as the addition thereof does not impair the operation of the present invention, with the balance comprising substantially iron and unavoidable impurities.

Next, a description will be given below about a method for producing the forged part of the first invention.

The method in question involves holding steel having any of the above compositions at a temperature of (Ae1 point—30° C.) to Ae3 point for 10 seconds or more, allowing forging to proceed at that temperature (annealing and forging at an approximately two-phase region temperature), thereafter cooling the steel to a temperature of 3250 to 475° C. at an average cooling rate of 3° C./s or more, and holding the steel in that temperature range for 60 to 3600 seconds (austempering). Thus, a greatest feature of the present invention resides in the adoption of a unique heat treatment wherein annealing and forging are carried out simultaneously at an approximately two-phase region temperature, whereby it is possible to not only attain the reduction of cost but also improve the balance of strength and reduction of area.

The method in question will be described below step by step. As to "annealing and forging at a two-phase region temperature→austempering at a predetermined temperature" which features the method, these steps will be described below with reference to FIG. 1 which outlines these steps.

First, steel having any of the foregoing compositions is held (soaked) at a temperature of (Ae1 point—30° C.) to Ae3 point (T1 in FIG. 1) for 10 seconds or more (t1 in FIG. 1) and is forged at that temperature. By thus setting the heating temperature at an approximately two-phase region temperature, ferrite is produced and a desired fine second phase structure is obtained. Of course, no limitation is made to this method, but a desired ferrite may be produced by going through the temperature range of (Ae1 point—30° C.) to Ae3 point in the course of soaking at a temperature of Ae3 point or higher and subsequent cooling.

The temperature T1 varies depending on the working ratio (synonymous with draft) and the amount of heat generated during working, but generally, when the working ratio is high, a fine second phase structure is easier to be produced at a lower temperature than the lower limit (Ae1 point) of the two-phase region temperature. For this reason, a lower limit of the heating temperature T1 was set at (Ae1 point—30° C.). On the other hand, if the heating temperature exceeds Ae3 point, a desired ferrite is not obtained. It is preferable that the heating temperature adopted in the present invention be as close as possible to the lower limit of the two-phase region temperature. The heating temperature is controlled to a temperature in an appropriate range depending on the components contained in the steel used.

The heating time t1 (soaking time) is set at 10 seconds or longer (preferably 30 seconds or longer), whereby there is obtained a uniform structure. Although an upper limit of the heating time t1 is not specially limited, it is recommended that the heating time t1 be controlled to 600 seconds or less, tanking productivity, etc. into account.

Next, forging is performed at the above temperature. It is not always necessary that the forging temperature be completely the same as the above heating temperature. The forging temperature may be changed if only the forging temperature is within the range [(Ae1 point—30° C.) to A3 point] defined in the present invention. Forging may be done by pressing (forging) the steel with use of a die heated to a temperature falling under the above range.

It is recommended that a lower limit of forging quantity (working quantity) be set at 10%. This is because if the working quantity is small, the second phase structure does not become fine and desired characteristics are not obtained. The lower limit is preferably 20% or more, more preferably 30% or more. An upper limit of the forging quantity is not specially limited, but as the working quantity increases, the workability is deteriorated, there arises the necessity of increasing the capacity of a press machine used, the production scale becomes too large, and cracking is apt to occur when the steel is processed into a part. Taking these points into account, it is recommended to set an upper limit of the forging quantity to approximately 150%, more preferably 120%.

Next, cooling is performed to a temperature of 325° to 475° C. (T2 in FIG. 1) at an average cooling rate (CR in FIG. 1) of 3° C./s or more, followed by holding in this temperature range for 60 to 3600 seconds (t2 in FIG. 1) (austempering). The austempering is important for forming a predetermined amount of retained austenite.

The above cooling rate CR is set at 3° C./s or more. By thus controlling the average cooling rate after heating it is possible to suppress the formation of pearlite. Preferably, the average cooling rate is 5° C./s or more, more preferably 10° C./s or more. An upper limit of the average cooling rate is not specially set. The higher, the better. However, in relation to the actual operation level, it is recommended to control the upper limit appropriately.

Cooling is performed to a temperature of 325° to 475° C. at the above average cooling rate, followed by holding in this temperature range for 60 to 3600 seconds (austempering), whereby a predetermined amount of retained austenite is produced and the concentration of C into γR can be attained in a large amount and in an extremely short time.

First, the austempering temperature (T2) is set at a temperature of 325° to 475° C. If the austempering temperature is lower than 325° C., there will not be obtained a predetermined amount of retained austenite because the diffusion rate of carbon is low. Preferably, the austempering temperature is 350° C. or higher. An upper limit thereof is set at 475° C. If the austempering temperature exceeds 475° C., not only there will be a precipitate of carbides, but also carbon will not be sufficiently concentrated into austenite (γ), not affording a predetermined amount of retained austenite. Preferably, the upper limit is 450° C. or lower.

The austempering time (t2) is set at 60 to 3600 seconds. If it is shorter than 60 seconds, the concentration of carbon will be insufficient and a predetermined amount of retained austenite will not be produced. Preferably, the austempering time is 100 seconds or longer. However, if it exceeds 3600 seconds, the retained austenite once produced will become decomposed. Preferably, the austempering time is up to 3000 seconds.

The above austempering step is followed by cooling. It is recommended to conduct cooling promptly while taking care so as not to perform heating beyond the austemperating temperature. This is for avoiding the decomposition of retained austenite.

The following description is now provided about components which constitute the high-strength forged part of the second invention.

Reference will be made first to the structure in the second invention.

(1) Tempered Bainite or Tempered Martensite: 50% or More

By "tempered bainite and/or tempered martensite" in the second invention is meant one which is low in dislocation density, soft, and has crystal grains of a vitreous structure. In contrast therewith, martensite is high in dislocation density and has a hard structure, thus is different from the tempered martensite. Both can be distinguished from each other for example by observation through a transmission type electron microscope (TEM).

As will be described later, the tempered bainite and tempered martensite having such features can be obtained, for example, by forging bainite and martensite at a temperature of (Ae1 point—30° C.) to (Ae3 point—30° C.) after quenching at a temperature of Ae3 point or higher (γ region).

For allowing the stretch flange formability improving effect induced by the tempered bainite or tempered martensite to be exhibited effectively, the space factor of the tempered bainite or tempered martensite is set at 50% or more relative to the entire structure. The space factor of the tempered bainite or tempered martensite depends on the balance with the second phase structure (especially γR) and should be controlled appropriately so that desired characteristics can be exhibited. But it is recommended that the space factor in question be set preferably at 55% or more, more preferably 60% or more, and be set preferably at 85% or less, more preferably 80% or less.

(2) Second Phase Structure: Retained Austenite (γR) and Martensite

The forged part in this second invention has the above base phase structure and contains, as the second phase structure, retained austenite and martensite (the content of martensite may be zero), and may further contain polygonal ferrite and bainite.

(2-1) Retained Austenite

As noted earlier, retained austenite is effective particularly in improving the total elongation. For allowing such a function to be exhibited effectively, the content of retained austenite is set at 3% or more (preferably 5% or more) and 30% or less (preferably 20% or less, more preferably 15% or less) relative to the entire structure.

It is recommended that the concentration of C in the retained austenite, (CγR), be 0.8% or more. The $C_{\gamma R}$ exerts a great influence on TRIP characteristics, and controlling it to 0.8% or more is effective particularly improving elongation. It is preferably 1% or more, more preferably 1.2% or more. The higher the $C_{\gamma R}$, the more preferable, but an adjustable upper limit in actual operation is considered to be approximately 1.6%.

(2-2) Martensite, Polygonal Ferrite, Bainite (all including 0%)

In the second phase structure there may be further contained martensite, polygonal ferrite, and bainite as other different structures (all including 0%) insofar as they do not impair the operation of the present invention. These components can inevitably be retained in the course of production according to the present invention, but the smaller their amounts, the more preferable. A total amount thereof is preferably 40% or less, more preferably 30% or less, still more preferably 10% or less.

In the second phase structure, moreover, as to the retained austenite and martensite, a space factor of retained austenite and martensite having an aspect ratio (major axis/minor axis ratio) of 2 or less is set at 25% or less. Thus, in the retained austenite and martensite which constitute the second phase structure, the space factor of a portion thereof relatively close to a circular shape in terms of aspect ratio (2 or less) is suppressed to 25% or less. In other words, a proportion of those relatively elongated and having and having an aspect ratio of higher than 2 is in excess of 75%, whereby it is possible to ensure an excellent strength—reduction of area balance. As noted above, the reason why a desired strength—reduction of area balance is not obtained even if TRIP steel is forged by the conventional method is that coarse martensite is produced in a large amount. In the present invention, for suppressing the formation of coarse martensite, there is adopted a unique heat treatment (performing austempering after annealing and forging at an approximately two-phase region temperature), whereby a large proportion of retained austenite and martensite is made into a relatively elongated form of larger than 2 in aspect ratio.

As to a portion of the retained austenite and martensite, which portion is 2 or less in an aspect ratio, the smaller an area fraction thereof, the better, but it is preferable that the area fraction of the said portion be set at 10% or less, more preferably 5% or less.

A description will now be given of basic components which constitute the forged part of the second invention. In the following description, the contents of chemical components are all in mass %.

C: 0.1% to 0.5%

C is an element essential for ensuring a high strength and for ensuring retained austenite. More specifically, C is an important element for ensuring a sufficient content of C in austenite phase and for allowing a desired austenite phase to be retained even at room temperature. C is useful for improving elongation characteristic. However, if C is added in an amount exceeding 0.5%, it becomes difficult to perform forging in two phase region due to for example the generation of heat during forging, thus making it difficult to afford a desired structure.

As to elements other than C, they are the same as in the first invention. That is, the same essential ranges as in the previous first invention exist with respect to Si+Al, Mn, P, and S, and the same preferred ranges as in the previous first invention exist with respect to Mo, Ni, Cu, Cr, Ti, Nb, V, Ca, REM, and B. The grounds for limitation of those ranges are also the same as in the previous first invention.

The forged part of this second invention contains the above basic components and optional components and may further contain other allowable components insofar as the addition thereof does not impair the operation of the invention, with the balance substantially comprising iron and unavoidable impurities.

Next, a description will be given below about a method for producing the forged part of the second invention.

The method according to this second invention involves holding steel at a temperature of (Ae1 point—30° C.) to (Ae3 point—30° C.) for 10 seconds or more, the steel having any of the above compositions and with bainite structure (untempered bainite structure; quenched bainite structure) or martensite structure (untempered martensite structure; quenched martensite structure) incorporated therein, forging the steel at that temperature, thereafter cooling the steel to a temperature of 325° to 475° C. at an average cooling rate of 3° C./s or more, and holding the steel in that temperature range for 60 to 3600 seconds. Thus, a greatest feature of the present invention resides in adopting a unique heat treatment wherein both annealing and forging are carried out simultaneously at an approximately two-phase region temperature, whereby it is possible to attain the reduction of cost and improve the balance of strength and reduction of area.

Figure 3:
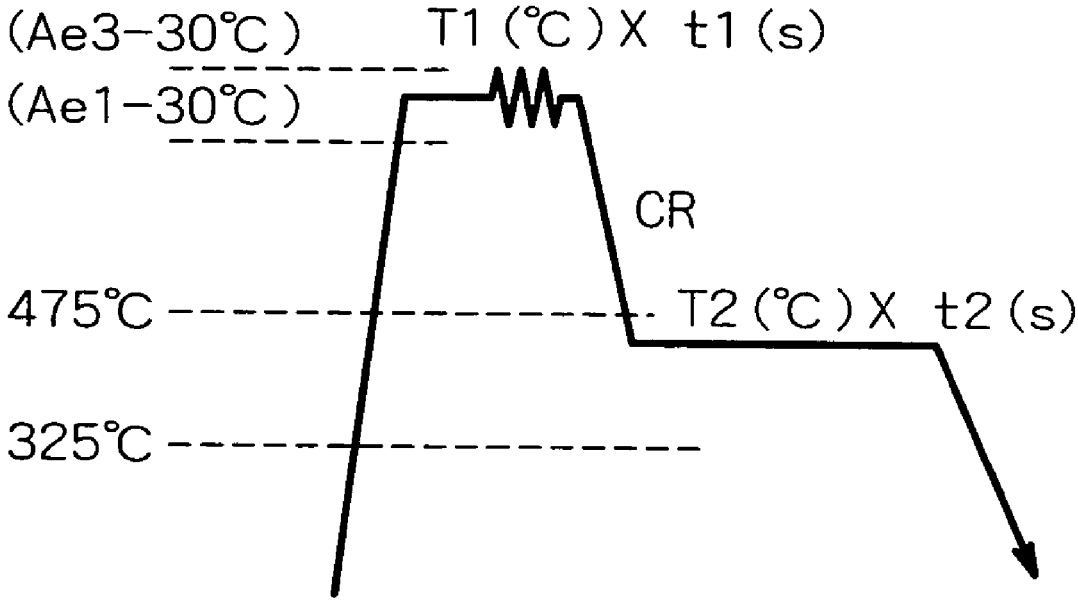
FIG. 3 is a schematic diagram illustrating a heat treatment step in the present invention (second invention)

The method in question will be described below step by step. As to "annealing and forging at a two-phase region temperature→austempering at a predetermined temperature" which features the method, these steps will be described with reference to FIG. 3 which outlines these steps.

First, steel with bainite structure or martensite structure incorporated therein is produced, for which there may be adopted a conventional method. For example, steel having been heated and held in an austenite region (e.g., steel having been held at a temperature of Ae3 point or higher for 10 seconds or longer) is rapidly cooled to a temperature of Ms point to Bs point and is thereafter subjected to isothermal transformation, whereby bainite structure can be introduced into the steel, while martensite structure can be introduced into the aforesaid steel by rapidly cooling the steel to a temperature of Ms point or lower. As to pearlite structure, it is not desirable for the invention, so a cooling pattern is set so as to avoid the pearlite transformation region. It is recommended to set the cooling rate for example at 10° C./s or more (preferably 20° C./s or more). When actual operation is taken into account, it is efficient to carry out the introduction of bainite structure or martensite structure in the course of cooling after hot rolling. Alternatively, bainite structure or martensite structure may be introduced by rapidly cooling the steel at a cooling rate of 10° C./s or higher after hot rolling and by subsequent winding at an extremely low temperature (e.g., room temperature to 500° C.).

Next, the steel with the bainite structure or martensite structure thus introduced therein is held (soaked) at a temperature of (Ae1 point—30° C.) to (Ae3 point—30° C.) (T1 in FIG. 3) for 10 seconds or longer (t1 in FIG. 3) and is forged at that temperature. By thus controlling the heating temperature there can be obtained a desired second phase structure.

The heating temperature T1 also varies depending on the working ratio (synonymous with draft) and the amount of heat generated (approximately 30° C. or lower depending on the working ratio). Generally, when the working ratio is high, the heating temperature T1 is lower than the lower limit (Ae1 point) of the two-phase region temperature, a second phase structure (retained austenite and martensite) having a large aspect ratio is easy to be produced. For this reason, a lower limit of the heating temperature T1 is set at (Ae1 point—30° C.). On the other hand, if an upper limit of the heating temperature T1 exceeds (Ae3 point—30° C.), a desired structure is not obtained, taking the generation of heat during working also into account, so the upper limit is set at (Ae3 point—30° C.).

As to the heating time t1 (soaking time), it is set at 10 seconds or longer (preferably 30 seconds or higher), whereby there is obtained a uniform structure. An upper limit of the heating time t1 is not specially limited, but, taking productivity, etc. into account, it is recommended to control the heating time to 600 seconds or lower.

Subsequent steps and manufacturing conditions adopted therein are the same as in the previous first embodiment. That is, the procedure goes through the steps of forging→cooling→austempering→cooling. However, only the forging temperature is different from that adopted in the previous first invention. The forging temperature in this second invention is [(Ae1 point—30° C.) to (Ae3 point—30° C.)].

The present invention will be described in detail by way of working examples thereof. However, the following examples do not restrict the present invention and changes not departing from the above and the following gist are all included in the technical scope of the present invention.

EXAMPLE 1

In this Example a study was made about the influence of various changes in component compositions and forging conditions on mechanical characteristics in connection with the first invention.

First, hot-rolled round steel bars each having a diameter of 13 mm were fabricated using No.1 to No. 12 steel samples of component compositions described in Table 1 (units in the same table are mass % and the balance comprises iron and unavoidable impurities) and were then machined into forging test pieces of 10 mm×10 mm×80 mm, which were then subjected to the following heat treatments A, B or C to afford forged parts. For reference, Ae1 and Ae3 points in the steel samples are also described in Table 1.

[A (A Conventional Method)]

Forging in a die heated to 900° C. (Ae3 point or higher) (application of compression forging strains at a working ratio R of 50%)→cooling at an average cooling rate of 10° C./s tempering (500° C., 10 minutes)

[B (A Comparative Method)]

Forging in a die heated to 900° C. (Ae3 point or higher) (application of compression forging strains at a working ratio R of 50%)→cooling at a cooling rate of 10° C./s→heating at 760° C. for 1 minute→cooling at an average cooling rate of 10° C./s→austempering (holding at 400° C. for 300 seconds)

[C (A Method According to the Present Invention)]

Heating at a temperature of (Ae+10° C.) for 20 minutes according to the type of each steel sample→forging in a die heated to the temperature of Ae1 point (application of compression forging strains at a working ratio R of 10% to 70%)→cooling at an average cooling rate of 10° C./s→austempering (holding at 400° C. for 300 seconds)

Forged parts thus obtained were then measured for tensile strength (TS), reduction of area (RA), space factor (area fraction) of each structure, an average grain diameter of a second phase structure and a space factor (represented by V* in Table 2) of a coarse second phase structure in the said second phase structure, in the following manner.

[Tensile Strength]

A JIS4B test piece (gauge length 20 mm, parallel portion length 22 mm, width 6 mm, thickness 1.2 mm) is cut out from one-fourth thickness of each forged part and is then subjected to a tensile test at 20° C. and at a crosshead speed of 1 mm/min.

[Reduction of Area]

Fractured faces of a fractured test piece (a test piece processed for use in tensile strength measurement) are brought face to face with each other, then the thickness and width at the center of the fractured portion are measured and a sectional area S after the fracture of the test piece is measured. Further, a difference (S0−S) between the sectional area S and an original sectional area S0 before the test is divided by S0 and the quotient obtained is represented in terms of percentage [(S0−S)/S0×100 (%)] for the evaluation of reduction of area.

[Observation of Structure]

Each forged part is etched using nital and a structure in the forged part is identified by observation through a scanning electron microscope (SEM: magnification 1000× or 2000×). Thereafter, a space factor (area fraction) of the structure is determined. Further, each forged part is ground to a one-fourth thickness, then is subjected to chemical grinding and is thereafter measured for retained austenite by an X-ray diffraction method (ISIJ Int. Vol. 33. (1933), No. 7, P. 776).

[Average Grain Diameter, etc. of Second Phase Structure]

First, each forged part is subjected to Lepera etching and is then observed through a scanning electron microscope (SEM: magnification 1000×) to obtain two structure photographs. An arbitrary region of 50 μm×50 μm is selected and cut out from each photograph. From the two photographs thus cut out, a total area ① of a second phase structure (γR, as well as bainite and/or martensite) in the total area of the cut-out portions (50 μm×50 μm×2) is determined and an average grain diameter of the second phase structure is determined by image processing.

Next, a total area ② of a coarse second phase structure (a portion whose average grain diameter is 1.5 times or more as large as an average grain diameter, d, of the second phase structure) in the second phase structure is calculated in the same way as above. From the above ① and ② there is determined a space factor of the coarse second phase structure in the second phase structure.

The results obtained are shown in Table 2.

The following can be guessed from the above results (all of the following No. mean No. in Table 2).

First, No. 7 to 13, 16, and 19 to 26 are examples of having produced forged parts having predetermined structures by the method C defined in the present invention, using steels (No. 2 to 10 and 12 in Table 1) which fall under the scope of the present invention. According to these examples, by simultaneous execution of both forging and heat treatment, without separate executions of the two, there were obtained high-strength forged parts superior in both elongation and balance of strength and reduction of area.

Of these examples, No. 7 to 13 are examples in which high-strength forged parts were produced using steel No. 3 having a component composition defined in the present invention and while changing the working ratio variously in the range of 10% to 70%. The forged parts obtained in these examples exhibit excellent elongation and balance of strength and reduction of area even at a high working ratio of 70%.

In contrast therewith, the following examples not satisfying any of the conditions specified in the present invention have the following inconveniences.

First, No. 1 is an example using steel No. 1 small in the amount C, in which both elongation and balance of strength and reduction of area were deteriorated because a desired retained austenite was not obtained.

No. 25 is an example using steel No. 11 small in the amount of Si, in which both elongation and balance of strength and reduction of area were deteriorated because a desired retained austenite was not obtained.

No. 2, 5, 14, and 17 are examples of forging conducted by the conventional method A using steels having component compositions defined in the present invention, in which the balance of strength and reduction of area was deteriorated because a desired retained austenite was not obtained.

No. 3, 6, 15, and 18 are examples of forging conducted by the comparative method B using steels having component compositions defined in the present invention, in which the balance of strength and reduction of area was deteriorated because a coarse second phase structure was produced.

Figure 2A:
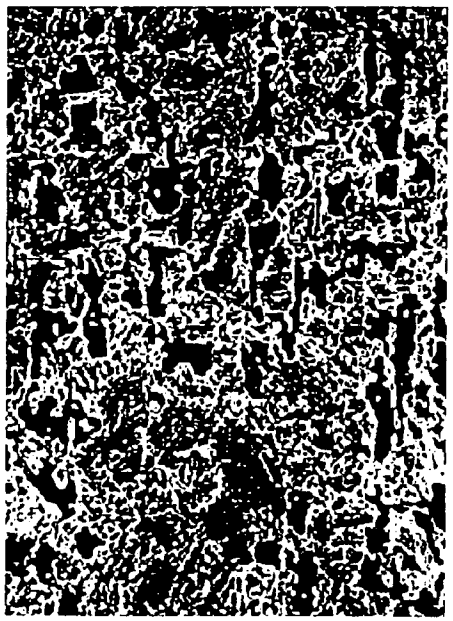
FIG. 2 comprises SEM photographs of No. 7 (example of the present invention; magnification 2000×), No. 5 (conventional example; magnification 1000×), and No. 6 (comparative example; magnification 2000×) in Example 1.
Figure 2B:
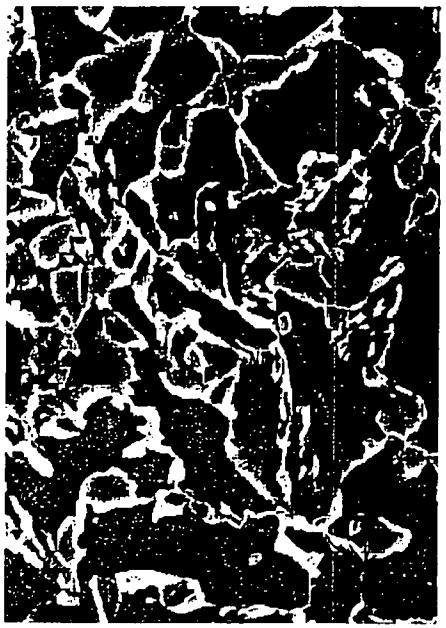
Figure 2C:
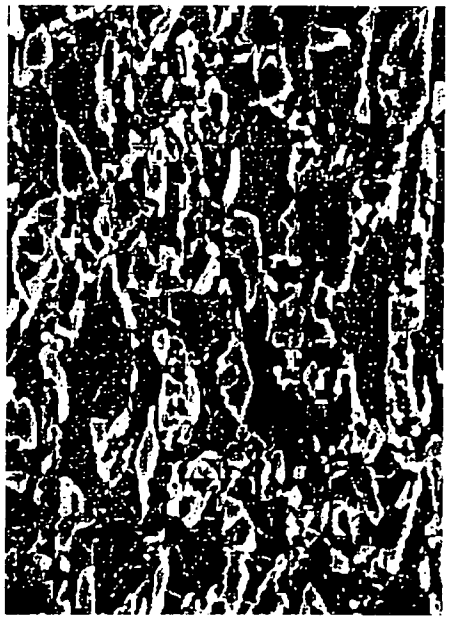

For reference, FIGS. 2(*a*) to 2(*c*) show SEM photographs (magnification of No. 5 is 1000× and that of No. 6 and 7 is 2000×) obtained in an example (No. 7) of the present invention, a conventional example (No. 5), and a comparative example (No. 6). From these photographs it is seen that in No. 7 meeting all the conditions defined in the present invention there is obtained a fine second phase structure, while in No. 5 and 6 not meeting the conditions defined in the present invention there is produced a coarse second phase structure.

EXAMPLE 2

In this Example a study was made about the influence of various changes in component composition and forging conditions on mechanical characteristics in connection with the second invention.

First, hot-rolled round steel bars each having a diameter of 13 mm were fabricated using steel samples of No. 1 to 12 having component compositions shown in Tale 3 (units in the same table are mass % and the balance comprises iron and unavoidable impurities) and were then machined into forging test pieces of 10 mm×10 mm×80 mm, which were then subjected to the following heat treatments A, B or C to afford forged parts. For reference, Ae1 and Ae3 points of the steel samples are also described in Table 3.

[A (A Conventional Method)]

Forging in a die heated to 900° C. (Ae3 point or higher) (application of compression forging strains at a working ratio R of 50%)→cooling at an average cooling rate of 10° C./s→tempering (500° C., 10 minutes)

[B (A Comparative Method)]

Forging in a die heated to 900° C. (Ae3 point or higher) (application of compression forging strains at a working ratio R of 50%)→cooling at a cooling rate of 10° C./s→heating at 760° C. (730° C. in the case of steel No. 12) for 1 minute→cooling at an average cooling rate of 10° C./s→austempering (holding at 400° C. for 300 seconds)

[C (A Method According to the Present Invention)]

Heating to 900° C. (Ae3 point or higher) and holding for 1 minute→cooling at an average cooling rate of 10° C./s→holding at 400° C. for 5 minutes and then cooling (cooling to 400° C. in case of introducing bainite structure, while in case of introducing martensite structure, cooling to room temperature)→heating to a temperature of 750° C. (740° C. for steel No. 5, 700° C. for steel No. 11 and 12) and holding for 60 seconds and subsequent forging in a die (application of compression forging strains at a working ratio R of 10% to 70%)→cooling at an average cooling rate of 10° C./s→austempering (400° C., 300 seconds) Forged parts thus obtained were then measured for tensile strength (TS), reduction of area (RA), and a proportion (represented by V* in Table 4) of a portion of retained austenite and martensite which portion is 2 or less in an aspect ratio, in the following manner.

[Tensile Strength]

A tensile test was conducted in the same way as in Example 1.

[Reduction of Area]

Reduction of area was evaluated in the same way as in Example 1.

[Observation of Structure]

Each forged part was etched with nital and a structure in the forged part was identified by observation through a scanning electron microscope (SEM: magnification 1000× or 2000×). Thereafter, an area fraction (tempered martensite, tempered bainite, and polygonal ferrite) of the structure was determined.

Retained austenite was measured for volume fraction (%) by a saturation magnetization measuring method [see Japanese Published Unexamined Patent Application No. 2003-90825, R&D Kobe Steel Technical Report/Vol. 52, No. 3 (Dec. 2002)]. This is because in the above SEM observation it is difficult to distinguish between retained austenite and martensite. According to the saturation magnetization measuring method, retained austenite is calculated in terms of a volume fraction, but the volume fraction of retained austeinite is considered substantially equal to the area fraction, so in the present invention the volume fraction of retained austenite is regarded as the area fraction of retained austenite.

Martensite structure in each forged part was determined by subtracting "a volume fraction of retained austenite (=area fraction of γR)" calculated by a saturation magnetization method from "a total area fraction of retained austenite and martensite" calculated by SEM observation.

In this way a base phase structure (tempered martensite/tempered bainite) and a second phase structure (γR, martensite, polygonal ferrite) in each forged part were determined, and in the case where the total of these structures was not 100 area %, the remaining structure (i.e., a structure incapable of separation and analysis even by the foregoing SEM observation or saturation magnetization measuring method) was determined to be "bainite structure."

[Aspect Ratio etc. of Retained Austenite and Martensite]

First, each forged part is subjected to Lepera etching and is then observed through a scanning electron microscope (SEM: magnification 1000×) to obtain two structure photographs. Then, an arbitrary area of 50 μm×50 μm is selected and cut out from each of the photographs. With respect to the two photographs thus cut out, a total area of retained austenite and martensite (1) in the total area (50 μm×50 μm×2) is determined and an aspect ratio of each structure is determined by image processing.

Next, a total area (2) of γR and martensite of 2 or less in aspect ratio is calculated in the same manner. Then, the total area (2) is divided by the total area (1) and the quotient obtained is represented in terms of percentage [(2)/(1)×100 (%)], which is described as V* (a proportion of a portion of retained austenite and martensite which portion is 2 or less in an aspect ratio).

The results obtained are shown in Table 4.

The following can be guessed from the above results (all of the following No. mean No. in Table 4).

First, all of No. 4, 7 to 13, 16, 20 to 24, and 26 are examples of having produced forged parts having predetermined structures by the method C defined in the present invention and using steels falling under the scope of the present invention. The forged parts were high-strength forged parts superior in both elongation and balance of strength and reduction of area.

Of these examples, No. 7 to 13 are examples of having produced forged parts by the method C according to the present invention using steel No. 3 having a component composition defined in the present invention and while changing the working ratio variously in the range of 10% to 70%. These forged parts are superior in both elongation and balance of strength and reduction of area even at a high working ratio of 70%.

In contrast therewith, the following examples not satisfying any of the conditions specified in the present invention have the following inconveniences.

First, No. 1 is an example of using steel No. 1 small in the amount of C, wherein a desired retained austenite was not obtained and the strength of the resultant forged part was low.

No. 25 is an example of using steel No. 11 small in the amount of Si, wherein both elongation and balance of strength and reduction of area were deteriorated because a desired retained austenite was not obtained.

No. 2, 5, 14, and 17 are examples of having produced forged parts by the conventional method A with use of steels having component compositions defined in the present invention, in which both elongation and balance of strength and reduction of area were deteriorated because a desired retained austenite was not obtained.

No. 3, 6, 15, and 18 are examples of having produced forged products by the comparative method B with use of steels having component compositions defined in the present invention, in which the balance of strength and reduction of area was deteriorated because of an increased proportion of retained austenite and martensite lower than 2 in aspect ratio.

No. 17 to 19 are examples of using steel No. 5 large in the amount of C. All of them are high strength, but low in elongation. Particularly, No. 17 produced by the conventional method A is low in the reduction of area and is markedly deteriorated in the balance of strength and reduction of area. As to No. 18 produced by the comparative method B and No. 19 produced by the method C of the present invention, the contents of retained austenite are in excess of the upper limit (30%), with consequent deterioration in the reduction of area. This is for the following reason. In the case of steel No. 5, as shown also in Table 1, the difference between Ae1 point (=751° C.) and Ae3 point (=775° C.) is only 24° C., so even if there is adopted the comparative method (B) involving austempering at a two-phase region temperature like No. 18, or even if there is adopted the method C (according to the present invention) involving forging at a predetermined temperature [(Ae1 point—30° C.) to (Ae3 point—30 inuC)] like No. 19, it is presumed that the temperature will actually exceed Ae3 point due to the generation of heat during working.

Figure 4A:
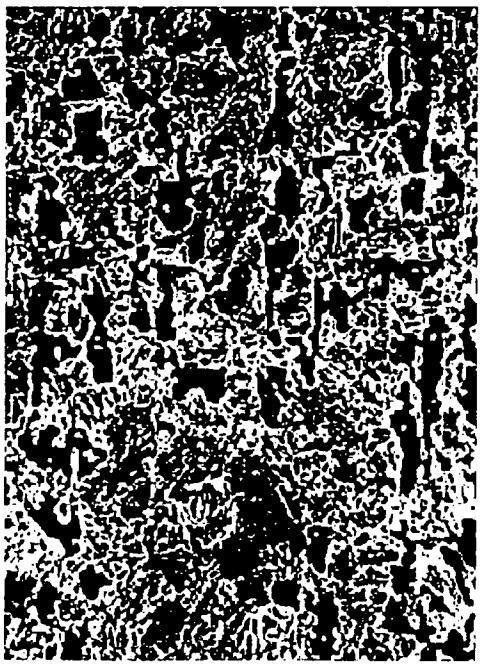
FIG. 4 comprises SEM photographs of No. 7 (example of the present invention; magnification 2000×), No. 5 (conventional example; magnification 1000×), and No. 6 (comparative example; magnification 2000×).
Figure 4B:
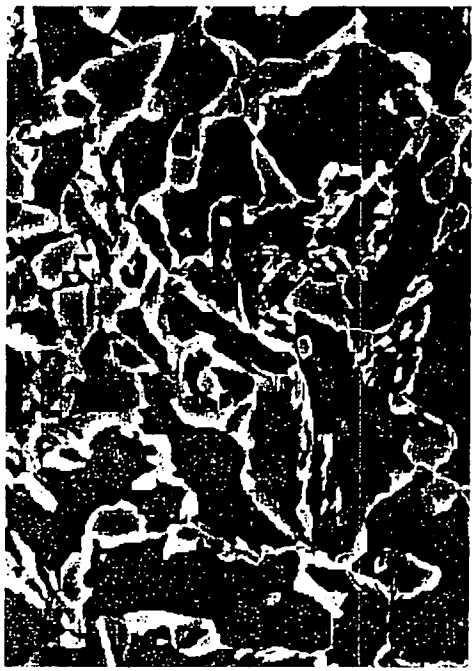
Figure 4C:
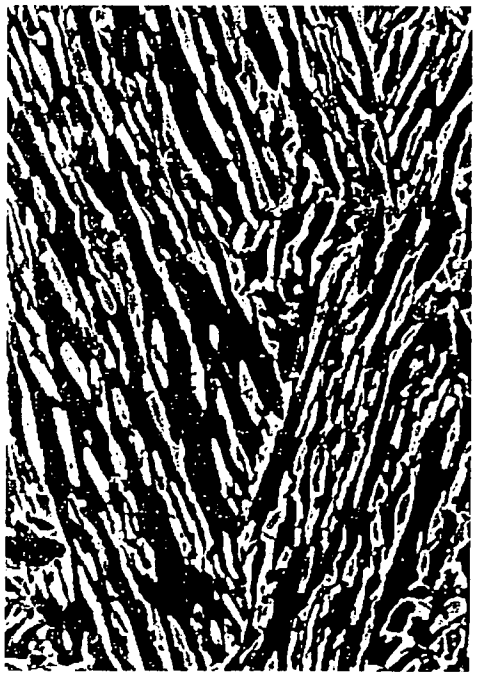

For reference, FIGS. 4(*a*) to (*c*) show SEM photographs (No. 5 magnification 1000×, No. 6 and 7 magnification 2000×) of an example (No. 7) of the present invention, a conventional example (No. 5), and a comparative example (No. 6). From these photographs it is seen that in the case of No. 7 satisfying all of the conditions defined in the present invention there are produced a large amount of retained austenite and martensite of a relatively elongated form having an aspect ratio exceeding 2, while in the case of No. 6 as a comparative example there are produced a large amount of lumpy retained austenite and martensite having an aspect ratio of smaller than 2. In the case of No. 5 as a conventional example there was produced a coarse martensite.

TABLE 1

| Steel No. | C | Si | Al | Si + Al | Mn | P | S | Cr | Mo | Others | $Ae_1$ | $Ae_3$ |
|---|---|---|---|---|---|---|---|---|---|---|---|---|
| 1 | 0.003 | 1.5 | 0.03 | 1.53 | 1.5 | 0.02 | 0.005 | — | — | | 751 | 921 |
| 2 | 0.11 | 1.5 | 0.03 | 1.53 | 1.5 | 0.02 | 0.006 | — | — | | 751 | 865 |
| 3 | 0.20 | 1.5 | 0.03 | 1.53 | 1.5 | 0.01 | 0.005 | — | — | | 751 | 841 |
| 4 | 0.41 | 1.5 | 0.03 | 1.53 | 1.5 | 0.01 | 0.004 | — | — | | 751 | 802 |
| 5 | 0.60 | 1.5 | 0.03 | 1.53 | 1.5 | 0.02 | 0.006 | — | — | | 751 | 775 |
| 6 | 0.20 | 1.5 | 0.03 | 1.53 | 1.5 | 0.01 | 0.004 | 0.3 | 0.1 | | 756 | 841 |
| 7 | 0.21 | 1.5 | 0.03 | 1.53 | 1.5 | 0.02 | 0.004 | — | — | Ni; 0.30, Cu: 0.30 | 751 | 828 |
| 8 | 0.20 | 1.5 | 0.03 | 1.53 | 1.5 | 0.01 | 0.005 | — | — | Ti; 0.03 | 751 | 841 |
| 9 | 0.19 | 1.5 | 0.03 | 1.53 | 1.5 | 0.01 | 0.006 | — | — | REM; 0.02 | 751 | 844 |
| 10 | 0.20 | 1.5 | 0.03 | 1.53 | 1.5 | 0.02 | 0.006 | — | — | B: 0.008 | 751 | 841 |

TABLE 1-continued

| Steel No. | C | Si | Al | Si + Al | Mn | P | S | Cr | Mo | Others | $Ae_1$ | $Ae_3$ |
|---|---|---|---|---|---|---|---|---|---|---|---|---|
| 11 | 0.20 | 0.3 | 0.03 | 0.33 | 1.5 | 0.02 | 0.006 | — | — | | 716 | 788 |
| 12 | 0.41 | 0.2 | 0.80 | 1.00 | 1.5 | 0.01 | 0.006 | — | — | | 713 | 744 |

TABLE 2

| | | Manufacturing Conditions | | Base Phase | | | | | | | | | |
|---|---|---|---|---|---|---|---|---|---|---|---|---|---|
| | Steel | | Working | Structure | Second Phase Structure | | | | | Mechanical Charcteristics | | | |
| No. | No. | Method | Ratio | F | $\gamma_R$ | $[\gamma_R]/[C]$ | Others | d | V* | TS | EL | RA | TS * RA |
| 1 | 1 | C | 50 | 100 | 0 | 0 | 0 | — | — | 472 | 33 | 70 | 33040 |
| 2 | 2 | A | 50 | 78 | 0 | 0 | 22 | — | — | 610 | 21 | 24 | 14640 |
| 3 | 2 | B | 50 | 72 | 10 | 91 | 18 | 4.3 | 31 | 622 | 31 | 35 | 21770 |
| 4 | 2 | C | 50 | 74 | 12 | 109 | 14 | 2.2 | 0 | 639 | 33 | 57 | 36423 |
| 5 | 3 | A | 50 | 72 | 0 | 0 | 28 | 15.0 | 0 | 830 | 18 | 15 | 12450 |
| 6 | 3 | B | 50 | 65 | 13 | 65 | 22 | 4.8 | 27 | 812 | 28 | 27 | 21924 |
| 7 | 3 | C | 50 | 68 | 15 | 75 | 17 | 1.6 | 0 | 860 | 26 | 49 | 42140 |
| 8 | 3 | C | 10 | 58 | 12 | 60 | 30 | 2.2 | 3 | 824 | 27 | 45 | 37080 |
| 9 | 3 | C | 20 | 62 | 13 | 65 | 25 | 2.3 | 0 | 832 | 26 | 44 | 36608 |
| 10 | 3 | C | 30 | 70 | 15 | 75 | 15 | 2.0 | 4 | 840 | 26 | 45 | 37800 |
| 11 | 3 | C | 40 | 59 | 15 | 75 | 26 | 1.9 | 0 | 855 | 28 | 45 | 38475 |
| 12 | 3 | C | 60 | 61 | 15 | 75 | 24 | 1.6 | 0 | 861 | 28 | 46 | 39606 |
| 13 | 3 | C | 70 | 68 | 15 | 75 | 17 | 1.7 | 2 | 870 | 29 | 49 | 42630 |
| 14 | 4 | A | 50 | 56 | 0 | 0 | 44 | 18.3 | 0 | 1298 | 10 | 16 | 20768 |
| 15 | 4 | B | 50 | 51 | 25 | 63 | 24 | 6.1 | 29 | 1322 | 23 | 21 | 27762 |
| 16 | 4 | C | 50 | 55 | 27 | 68 | 18 | 1.9 | 0 | 1348 | 25 | 42 | 56616 |
| 17 | 5 | A | 50 | 35 | 4 | 7 | 61 | 14.5 | 0 | 1499 | 6 | 5 | 7495 |
| 18 | 5 | B | 50 | 41 | 33 | 55 | 26 | 4.5 | 33 | 1561 | 19 | 14 | 21854 |
| 19 | 5 | C | 50 | 39 | 35 | 58 | 26 | 1.7 | 5 | 1533 | 21 | 37 | 56721 |
| 20 | 6 | C | 50 | 62 | 14 | 70 | 24 | 2.2 | 0 | 991 | 24 | 41 | 40631 |
| 21 | 7 | C | 50 | 58 | 13 | 62 | 29 | 2.0 | 0 | 966 | 25 | 46 | 44436 |
| 22 | 8 | C | 50 | 58 | 14 | 70 | 28 | 2.3 | 0 | 940 | 27 | 51 | 47940 |
| 23 | 9 | C | 50 | 66 | 14 | 74 | 20 | 2.1 | 0 | 855 | 25 | 49 | 41895 |
| 24 | 10 | C | 50 | 59 | 13 | 65 | 28 | 1.8 | 4 | 888 | 24 | 47 | 41736 |
| 25 | 11 | C | 50 | 55 | 2 | 10 | 43 | 2.0 | 0 | 673 | 22 | 32 | 21536 |
| 26 | 12 | C | 50 | 52 | 25 | 61 | 23 | 2.1 | 0 | 911 | 24 | 44 | 40084 |

Note:
F = Ferrite,
$\gamma_R$ = Retained austenite,
Others = Bainite and/or martensite,
d = Average grain, diameter of the second phase structure,
V* = Space factor of a coarse second phase structure in the second phase structure

TABLE 3

| Steel No. | C | Si | Al | Si + Al | Mn | P | S | Cr | Mo | Others | $Ae_1$ | $Ae_3$ |
|---|---|---|---|---|---|---|---|---|---|---|---|---|
| 1 | 0.003 | 1.5 | 0.03 | 1.53 | 1.5 | 0.02 | 0.005 | — | — | | 751 | 921 |
| 2 | 0.11 | 1.5 | 0.03 | 1.53 | 1.5 | 0.02 | 0.006 | — | — | | 751 | 865 |
| 3 | 0.20 | 1.5 | 0.03 | 1.53 | 1.5 | 0.01 | 0.005 | — | — | | 751 | 841 |
| 4 | 0.41 | 1.5 | 0.03 | 1.53 | 1.5 | 0.01 | 0.004 | — | — | | 751 | 802 |
| 5 | 0.60 | 1.5 | 0.03 | 1.53 | 1.5 | 0.02 | 0.006 | — | — | | 751 | 775 |
| 6 | 0.20 | 1.5 | 0.03 | 1.53 | 1.5 | 0.01 | 0.004 | 0.3 | 0.1 | | 756 | 841 |
| 7 | 0.21 | 1.5 | 0.03 | 1.53 | 1.5 | 0.02 | 0.004 | — | — | Ni; 0.30, Cu; 0.30 | 751 | 828 |
| 8 | 0.20 | 1.5 | 0.03 | 1.53 | 1.5 | 0.01 | 0.005 | — | — | Ti; 0.03 | 751 | 841 |
| 9 | 0.19 | 1.5 | 0.03 | 1.53 | 1.5 | 0.01 | 0.006 | — | — | REM; 0.02 | 751 | 844 |
| 10 | 0.20 | 1.5 | 0.03 | 1.53 | 1.5 | 0.02 | 0.006 | — | — | B: 0.008 | 751 | 841 |
| 11 | 0.20 | 0.3 | 0.03 | 0.33 | 1.5 | 0.02 | 0.006 | — | — | | 716 | 788 |
| 12 | 0.41 | 0.2 | 0.80 | 1.00 | 1.5 | 0.01 | 0.006 | — | — | | 713 | 744 |

TABLE 4

| | | Manufacturing Conditions | | Base Phase | | Second Phase | | | | | | | | |
|---|---|---|---|---|---|---|---|---|---|---|---|---|---|---|
| | Steel | | Working | Structure | | Structure | | | | | Mechanical Charcteristics | | | |
| No. | No. | Method | Ratio | TM | TB | PF | $\gamma_R$ | M | B | V* | TS | EL | RA | TS * RA |
| 1 | 1 | C | 50 | 82 | 0 | 18 | 0 | 0 | 0 | — | 477 | 32 | 72 | 34344 |
| 2 | 2 | A | 50 | 0 | 0 | 22 | 0 | 78 | 0 | 0 | 610 | 21 | 24 | 14640 |
| 3 | 2 | B | 50 | 0 | 0 | 72 | 10 | 6 | 12 | 91 | 622 | 31 | 35 | 21770 |
| 4 | 2 | C | 50 | 78 | 0 | 0 | 12 | 3 | 7 | 0 | 661 | 35 | 71 | 46931 |
| 5 | 3 | A | 50 | 0 | 0 | 28 | 0 | 72 | 0 | 0 | 830 | 18 | 15 | 12450 |
| 6 | 3 | B | 50 | 0 | 0 | 65 | 13 | 7 | 15 | 85 | 812 | 28 | 27 | 21924 |
| 7 | 3 | C | 50 | 76 | 0 | 0 | 16 | 3 | 5 | 0 | 865 | 26 | 61 | 52765 |
| 8 | 3 | C | 10 | 81 | 0 | 0 | 13 | 2 | 4 | 3 | 831 | 27 | 55 | 45705 |
| 9 | 3 | C | 20 | 79 | 0 | 0 | 13 | 4 | 4 | 0 | 835 | 27 | 65 | 54275 |
| 10 | 3 | C | 30 | 77 | 0 | 0 | 14 | 4 | 5 | 4 | 847 | 28 | 63 | 53361 |
| 11 | 3 | C | 40 | 76 | 0 | 0 | 15 | 3 | 6 | 0 | 870 | 29 | 55 | 47850 |
| 12 | 3 | C | 60 | 75 | 0 | 0 | 16 | 3 | 6 | 0 | 869 | 28 | 63 | 54747 |
| 13 | 3 | C | 70 | 76 | 0 | 0 | 15 | 3 | 6 | 2 | 885 | 28 | 60 | 53100 |
| 14 | 4 | A | 50 | 0 | 0 | 14 | 0 | 86 | 0 | 0 | 1298 | 10 | 16 | 20768 |
| 15 | 4 | B | 50 | 0 | 0 | 51 | 25 | 8 | 16 | 89 | 1322 | 23 | 21 | 27762 |
| 16 | 4 | C | 50 | 66 | 0 | 0 | 26 | 2 | 6 | 0 | 1355 | 26 | 53 | 71815 |
| 17 | 5 | A | 50 | 0 | 0 | 5 | 4 | 95 | 0 | 0 | 1499 | 6 | 5 | 7495 |
| 18 | 5 | B | 50 | 0 | 0 | 41 | 33 | 9 | 17 | 83 | 1561 | 19 | 14 | 21854 |
| 19 | 5 | C | 50 | 55 | 0 | 0 | 32 | 4 | 4 | 32 | 1546 | 21 | 19 | 29374 |
| 20 | 6 | C | 50 | 0 | 76 | 0 | 15 | 2 | 7 | 0 | 1003 | 24 | 55 | 55165 |
| 21 | 7 | C | 50 | 0 | 77 | 0 | 14 | 3 | 6 | 0 | 1010 | 26 | 57 | 57570 |
| 22 | 8 | C | 50 | 0 | 78 | 0 | 13 | 3 | 6 | 0 | 999 | 27 | 53 | 52947 |
| 23 | 9 | C | 50 | 0 | 77 | 0 | 15 | 3 | 5 | 0 | 879 | 26 | 54 | 47466 |
| 24 | 10 | C | 50 | 0 | 77 | 0 | 13 | 4 | 6 | 4 | 898 | 25 | 53 | 47594 |
| 25 | 11 | C | 50 | 89 | 0 | 0 | 2 | 3 | 6 | 82 | 687 | 18 | 36 | 24732 |
| 26 | 12 | C | 50 | 68 | 0 | 0 | 24 | 2 | 6 | 0 | 923 | 24 | 49 | 45227 |

Note:
TM = Tempered martensite,
TB = Tempered bainite,
F = Ferrite,
$\gamma_R$ = Retained austenite,
M = Martensite,
B = bainite,
V* = A proportion of a portion of retained austenite and martensite which portion is 2 or less in an aspect ratio

What is claimed is:

1. A high-strength forged part comprising a base phase structure and a second phase structure and containing the following components in mass % (also in the following):

C: 0.41% to 0.6%

Si+Al: 0.5% to 3%

Mn: 0.5% to 3%

P: 0.15% or less (not including 0%)

S: 0.02% or less (including 0%), wherein the base phase structure contains 30% or more of ferrite in terms of a space factor relative to the entire structure, the second phase structure comprises retained austenite, as well as bainite and/or martensite, the content of the retained austenite is represented by the following expression (1) relative to the entire structure, an average grain diameter, d, of the second phase structure is 5 μm or less, and a space factor of a coarse portion of (1.5×d) or more in an average grain diameter contained in the second phase structure is 15% or less:

$$50\times[C]<[V_{\gamma R}]<150\times[C] \quad (1)$$

where $[V_{\gamma R}]$ stands for a space factor of the retained austenite relative to the entire structure and [C] stands for the content (mass %) of C in the forged part.

2. A high-strength forged part according to claim 1, further containing at least one of Cr and Mo in a total amount of 1% or less (not including 0%).

3. A high-strength forged part according to claim 1, further containing at least one of:

Ni: 0.5% or less (not including 0%) and

Cu: 0.5% or less (not including 0%).

4. A high-strength forged part according to claim 1, further containing at least one of:

Ti: 0.1% or less (not including 0%),

Nb: 0.1% or less (not including 0%), and

V: 0.1% or less (not including 0%).

5. A high-strength forged part according to claim 1, further containing at least one of:

Ca: 0.003% or less (not including 0%) and

REM: 0.003% or less (not including 0%).

6. A high-strength forged part according to claim 1, further containing:

B: 0.003% or less (not including 0%).

7. A method for producing the high-strength forged part described in claim 1, which method comprises the steps of holding steel at a temperature of (Ae1 point−30° C.) to Ae3 point for 10 seconds or more, allowing the steel to be forged at that temperature, thereafter cooling the steel to a temperature of 325° to 475° C. at an average cooling rate of 3° C./s or more, and holding the steel in that temperature range for 60 to 3600 seconds, the steel containing the following components in mass %:

C: 0.41% to 0.6%
Si+Al: 0.5% to 3%
Mn: 0.5% to 3%
P: 0.15% or less (not including 0%)
S 0.02% or less (including 0%).

* * * * *